US005168858A

United States Patent [19]

Mong

[11] Patent Number: 5,168,858

[45] Date of Patent: Dec. 8, 1992

[54] IGNITION ENERGY AND DURATION AUGMENTATION

[76] Inventor: Frank Mong, P.O. Box 372, Hsin Chu, Taiwan

[21] Appl. No.: 756,603

[22] Filed: Sep. 9, 1991

[51] Int. Cl.[5] ..... F02D 3/02

[52] U.S. Cl. ..... 123/620; 123/605

[58] Field of Search ..... 123/620, 605, 596, 598, 123/653, 643; 331/112; 307/106; 363/21

[56] References Cited

U.S. PATENT DOCUMENTS

| | | | |
|---|---|---|---|
| 4,204,490 | 5/1980 | Ohki et al. | 123/653 |
| 4,217,873 | 8/1980 | Nishio et al. | 123/653 |
| 4,407,259 | 10/1983 | Abo | 123/620 |
| 4,463,744 | 8/1984 | Tanaka et al. | 123/643 |
| 4,479,467 | 10/1984 | Burrows et al. | 123/605 |
| 4,782,242 | 11/1988 | Kovacs | 307/106 |
| 4,868,730 | 9/1989 | Ward | 363/21 |
| 4,904,961 | 2/1990 | Minks | 331/112 |

FOREIGN PATENT DOCUMENTS

| | | | |
|---|---|---|---|
| 0143941 | 9/1980 | Fed. Rep. of Germany | 123/653 |

*Primary Examiner*—Raymond A. Nelli

[57] ABSTRACT

A motor vehicle high voltage ignition energy and duration augmentation comprising a primary recharging circuit, a diode capacitor circuit, a rear recharging circuit and a noise suppression circuit, wherein high voltage from an ignition coil is transmitted through said primary recharging circuit, said diode capacitor circuit, said rear recharging circuit and said noise suppression circuit to discharge through a spark plug for primary ignition, and at the same time, part of said high voltage is transmitted to charge the capacitor of said primary recharging circuit, the capacitor of said diode capacitor circuit and the capacior of said rear recharging circuit, causing the discharging resistor of said primary recharging circuit and the discharging resistor of said rear recharging circuit to instantaneously discharge high voltage for secondary ignition and, reverse voltage from said spark plug is sent to charge the capacitor of said rear recharging circuit and to drive the diodes of said diode capacitor to compensate the current.

1 Claim, 3 Drawing Sheets

IGNITION ENERGY AND DURATION AUGMENTATION

BACKGROUND OF THE INVENTION

The present invention relates to an ignition energy and duration augmentation and relates more particularly to a high voltage ignition energy and duration augmentation for any of a variety of motor vehicles.

Various methods or devices have been used for enlarging the combustion efficiency of motor vehicles. Adding additives in fuel or improving the quality of lubricating oil still can not achieve satisfactory effect. Using turbocharger may produce a satisfactory result, however, it is very expensive to install a turbocharger in a motor vehicle. Therefore, there is a strong demand for a simple, inexpensive and effective ignition energy and duration augmentation. Several ignition circuits have been disclosed for this purpose. These ignition circuits are not still satisfactory in use because they use low voltage to control the ignition coil and the structure of which is generally complicated. Further, they do not provide any means to eliminate or control reverse high voltage which may obstruct the operation of ignition.

SUMMARY OF THE INVENTION

The present invention has been accomplished under the circumstances in view. According to the present invention, the high voltage ignition energy and duration augmentation can be connected between the ignition coil and the distributor of a motor vehicle to divide the high voltage from the ignition coil into two parts, namely, a first part to charge the capacitor in a primary recharging circuit, the capacitor in a diode capacitor circuit and the capacitor in a rear recharging circuit and a second part to the spark plug for primary ignition. After primary ignition, the capacitors in the primary and rear recharging circuits are caused to discharge high voltage through discharging resistors for secondary ignition. The interval between the primary and secondary ignitions is so short that explosion is completed at the same combustion chamber, and therefore, combustion efficiency is enlarged. A noise suppression resistor is provided to eliminate from interference of external radio waves. After secondary ignition, reverse high voltage from the spark plug is sent back to charge the capacitors for repeated discharging operation so that reverse impulse can be eliminated or reduced to the minimum. The present invention can be electrically alternatively connected between the spark plug and the ignition coil or the distributor and the spark plug, or between the ignition coil and the distributor. Therefore, the high voltage ignition energy and duration augmentation of the present invention is easy to install.

DETAILED DESCRIPTION OF THE PREFERRED EMBODIMENT

Figure 1:
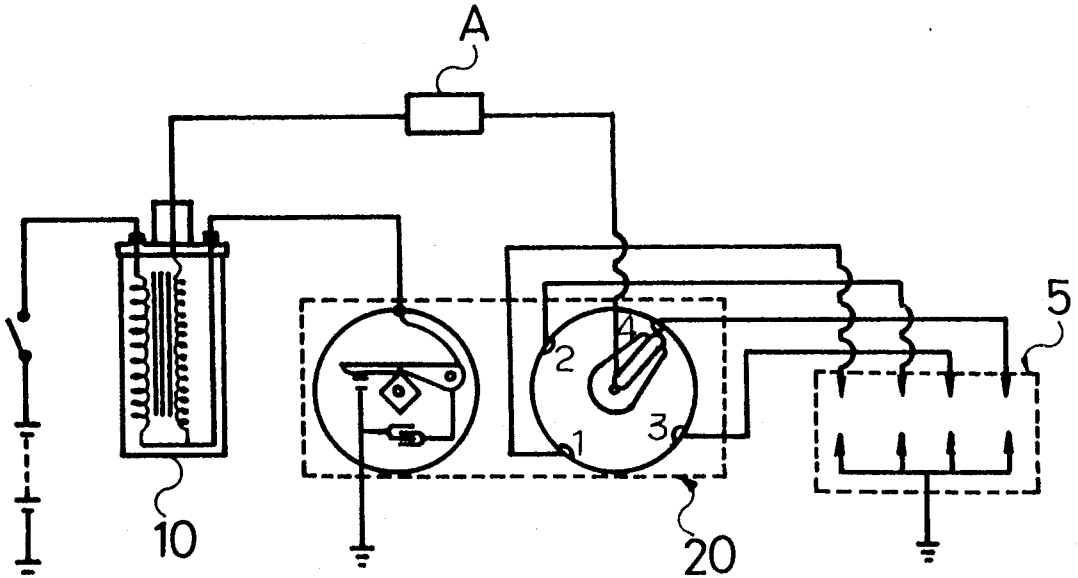
FIG. 1 is a schematic drawing illustrating an arrangement of the present invention in a motor vehicle's ignition system.

Referring to FIG. 1, a high voltage ignition energy and duration augmentation. A for a motor vehicle as constructed in accordance with the present invention is to be electrically connected between the ignition coil 10 and the distributor 20 of a motor vehicle and charged by the high voltage from the ignition coil 10 to produce a secondary ignition in the air gap 5 in the spark plug of the motor vehicle. As alternate ways, the ignition energy and duration augmentation of the present invention may be connected between the spark plug and the ignition coil, or between the distributor and the spark plug.

Figure 2:
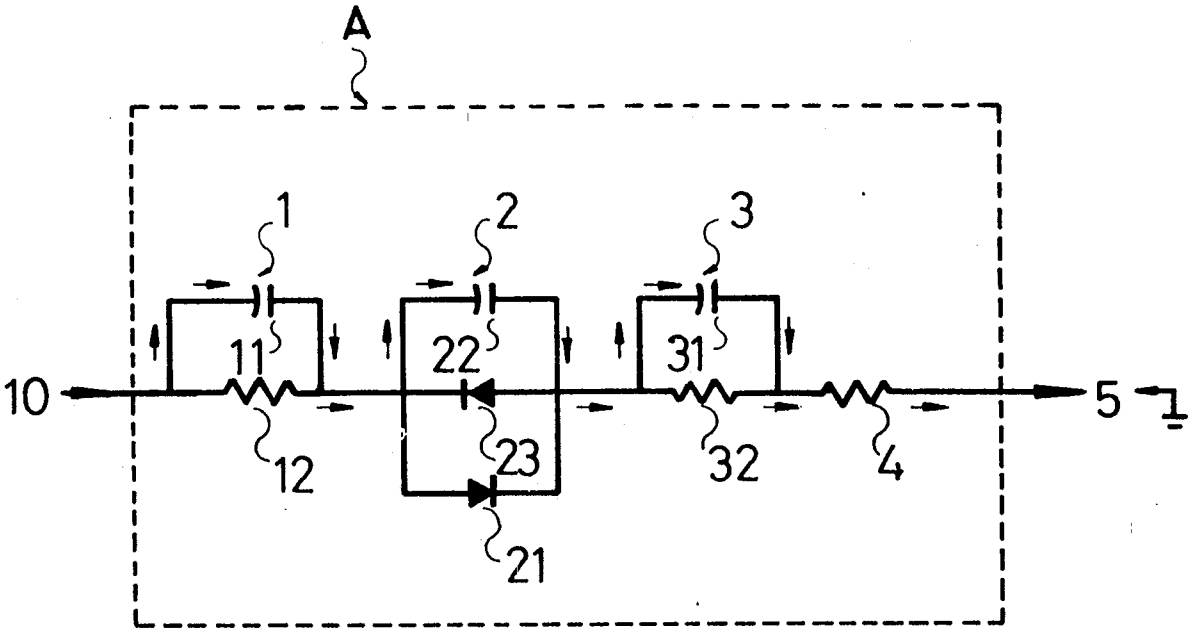
FIG. 2 is a circuit diagram of the present invention.

Referring to circuit diagram of the present invention as shown in FIG. 2, the circuit is generally comprised of a primary recharging circuit 1, a diode capacitor circuit 2, a rear recharging circuit 3, and a noise suppression resistor 4. The present invention provides four actions which are to be outlined hereinafter. High voltage from the ignition coil 10 is partly instantaneously transmitted to a resistor 12 in the primary recharging circuit 1, the diode 21 of the diode capacitor circuit 2 and a resistor 32 in the rear recharging circuit 3 and then, transmitted through the noise suppression resistor 4 to the air gap 5 in the spark plug for primary ignition. While transmitting to the primary recharging circuit 1, part of high voltage is transmitted through a capacitor 11 in the primary recharging circuit 1, the capacitor 22 of the diode capacitor circuit 2 and the capacitor 31 in the rear recharging circuit 3 for charging in proper order. After charging, the capacitor 11 in the primary recharging circuit 1 increases its electric resistance from zero ohm to a high lever. After full load, the capacitors 22, 31 are respectively charged. Once the aforesaid primary ignition process is completed, the capacitors 11, 22, 31 start to discharge through the resistors 12, 32, causing a secondary ignition to happen in the air gap 5. The diode capacitor circuit 2 is to stabilize the voltage and compensate the current while the capacitor 22 is charged by the high voltage from the resistor 12 and the diode 23. The noise suppression resistor 4 is to eliminate from interference of external radio waves. By means of the arrangement and the operation of the capacitor 11, the discharging resistor 12, the capacitor 31 and the discharging resistor 32, secondary ignition is performed to augment the combustion efficiency of motor vehicle.

Figure 3:
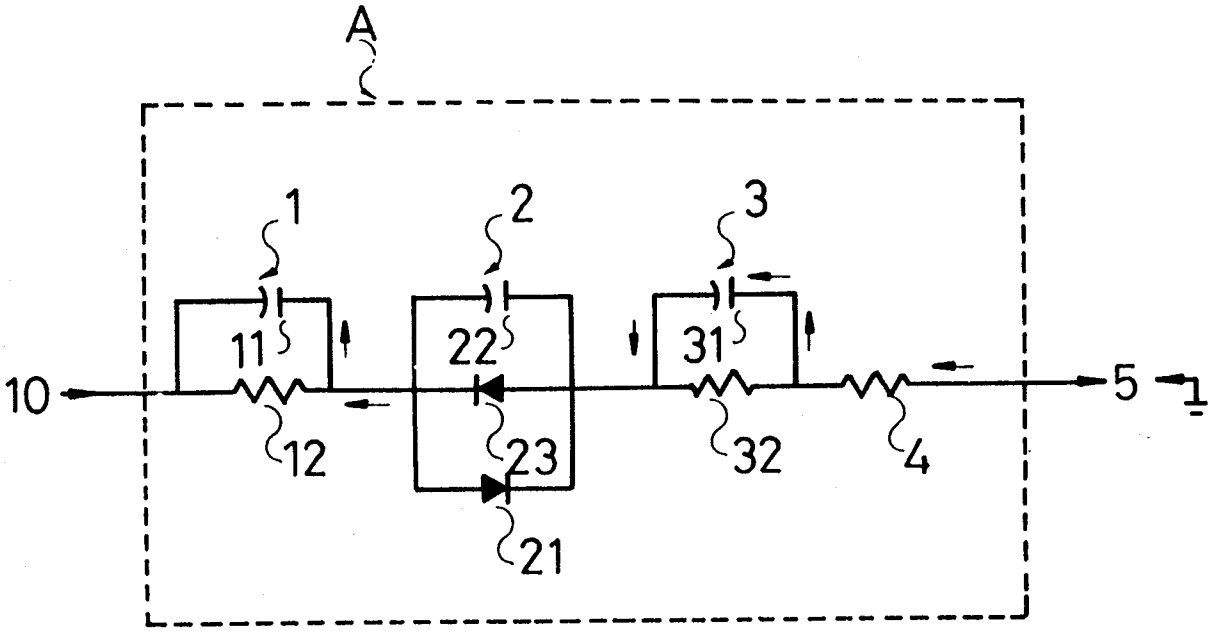
FIG. 3 illustrates the operation of the circuit of the present invention in treating reverse voltage.

Referring to FIG. 3, when high voltage is instantaneously discharged to make a secondary ignition in the air gap of the spark plug, remainder high voltage will be sent back through the circuit. While high voltage is sent back in reverse direction, the electric resistance at the capacitor 31 becomes zero, and therefore, reverse high voltage, after passing through the noise suppression resistor 4, charge the capacitor 31 again. As soon as the capacitor 31 is turned into a full load state, it can discharge high voltage through the discharging resistors 12, 32 again so as to repeatedly set a fire in the air gap 5 of the spark plug. This process is repeated again and again until all reverse voltage is completely consumed. Because the aforesaid charging and recharging process is repeatedly performed within short interval, reverse impluse from the spark plug is reduced to the minimum before next transmission of high voltage from the ignition coil. Therefore, next high voltage transmission can be smoothly performed.

While the invention has been described in conjunction with the preferred embodiment thereof, it is apparent that various modifications could be made to the present invention without departing from the basic teachings thereof.

What is claimed is:

1. Motor vehicle high voltage ignition energy and duration augmentation comprising four circuits in series as follows;

a primary recharging circuit, said primary recharging circuit comprising a capacitor and a discharging resistor connected in parallel with each other;

a diode capacitor circuit, said diode capacitor circuit comprising a forward diode, a backward diode and a capacitor respectively connected in parallel with one another;

a rear recharging circuit, said rear recharging circuit comprising a capacitor and a discharging resistor connected in parallel with each other;

a noise suppression circuit;

wherein high voltage from an ignition coil is transmitted through said primary recharging circuit, said diode capacitor circuit, said rear recharging circuit and said noise suppression circuit to discharge through a spark plug for primary ignition; and characterized in that part of said high voltage is transmitted to charge the capacitor of said primary recharging circuit, the capacitor of said diode capacitor circuit and the capacitor or said rear recharging circuit, causing the discharging resistor of said primary recharging circuit and the discharging resistor of said rear recharging circuit to instantaneously discharge high voltage for secondary ignition; reverse voltage from said spark plug being to charge the capacitor of said rear recharging circuit and to drive the diodes of said diode capacitor circuit to compensate the current.

* * * * *